US005135079A

United States Patent [19]

Shimazaki

[11] Patent Number: 5,135,079

[45] Date of Patent: Aug. 4, 1992

[54] NOISE PREVENTION APPARATUS FOR A CABLE WINCH ELEVATOR

[75] Inventor: Toshio Shimazaki, Kawagoe, Japan

[73] Assignee: Kabushiki Kaisha Toshiba, Kawasaki, Japan

[21] Appl. No.: 683,622

[22] Filed: Feb. 28, 1991

[30] Foreign Application Priority Data

Feb. 28, 1990 [JP] Japan ..... 2-48125

[51] Int. Cl.[5] ..... B66B 9/00

[52] U.S. Cl. ..... 187/1 R; 187/20; 181/206; 381/71

[58] Field of Search ..... 187/1 R, 17, 20; 181/206, 207; 381/71

[56] References Cited

U.S. PATENT DOCUMENTS

| | | | |
|---|---|---|---|
| 3,279,762 | 10/1966 | Bruns | 187/20 X |
| 3,826,870 | 7/1974 | Wurm et al. | 181/206 X |
| 3,945,468 | 3/1976 | Miura et al. | 187/1 R |
| 4,044,203 | 8/1977 | Swinbanks | 181/206 X |
| 4,079,816 | 3/1978 | Ohta | 187/1 R |
| 4,589,133 | 5/1986 | Swinbanks | 381/71 |
| 4,750,523 | 6/1988 | Crouse | 181/206 X |
| 4,805,733 | 2/1989 | Kato et al. | 181/206 |
| 5,010,576 | 4/1991 | Hill | 381/71 |
| 5,025,893 | 6/1991 | Saito | 187/20 |

FOREIGN PATENT DOCUMENTS 57-106670 7/1982 Japan .

*Primary Examiner*—Robert P. Olszewski
*Assistant Examiner*—Dean A. Reichard
*Attorney, Agent, or Firm*—Foley & Lardner

[57] ABSTRACT

A cable winch elevator noise prevention apparatus is provided with a winch on the top most floor of a building and having a main sheave that winds a cable up and down, to both ends of which are fixed an elevator cage and a counterweight, and at least two cable holes opened in a floor of a machine room on the topmost floor where the winch is installed, and so as to allow the cable wound around the main sheave to pass through and move freely up and down. This apparatus is provided with a vibration detector to detect vibration which is mounted in the vicinity of a vibration noise source inside the machine room that includes the winch, a noise predictor circuit that uses the vibration detected by the detector to predict the phase and the frequency of vibration noise that leaks from the cable holes to an elevator hoistway, a sound signal generator circuit that generates noise cancellation sound signals having a phase opposite to a phase of a noise waveform predicted by the predictor circuit, and a cancellation sound generator circuit provided in the vicinity of the cable holes that converts into actual sounds the sound signals of noise cancellation sounds having the opposite phase to the noise which have been generated by the generator circuit.

10 Claims, 11 Drawing Sheets

NOISE PREVENTION APPARATUS FOR A CABLE WINCH ELEVATOR

BACKGROUND OF THE INVENTION

The present invention relates to a noise prevention apparatus for a cable winch elevator, and more particularly, to a noise prevention apparatus for an elevator in which the noise that leaks to the outside of the machine room on the top floor to which a cable winch elevator is provided, and which is caused by vibration accompanying the rotational drive of the cable winch and the like, is reduced.

In general, elevators or lifts are defined as apparatus that use electrical or other drive means to convey persons and freight up and down. These elevators, comprise a cable winch usually provided in a machine room on the top floor of the building; a main sheave; a governor and controller apparatus; a cage that runs up and down and which is positioned in a hoistway that is provided vertically so as to pass through each floor of the building; a counterweight; guide rails for both the cage and the counterweight; and shock absorbers for both the cage and the counterweight. The ends of the cable that is wound around the main sheave are fixed to the cage and the counterweight respectively, and this cable moves in both the up and down directions accompanying slight movement through the cable holes located in at least two places in the floor of the machine room.

Accordingly, when the elevator is driven on the basis of commands from operation panels provided at the elevator doors on each floor, the motor of the cable winch generates vibration noise inside the machine room with the rotation of the main sheave, and this vibration noise is transmitted downwards via the cable holes and is transmitted as noise inside the hoistway for the elevator and to the inside of the cage.

Because of this, the "Elevator Noise Prevention Apparatus" disclosed in Japanese Utility Model Application Laid-Open Publication No. 57-106670 (1983) and shown in FIG. 1, has been proposed in order to prevent the transmission of vibration noise to the inside of the elevator cage. In FIG. 1, an elevator 10 comprises a winch 11, a main sheave 12 that is mounted on the motor (not indicated in the figure) of the winch 11, a cable 13 that is wound around the main sheave 12, and an elevator cage 14 and a counterweight 15 which are fixed to respective ends of the cable 13. A control apparatus 16 that controls the drive of the motor (not indicated in the figure) is built into the winch 11 and the floor 17 of a machine room in which the winch 11 and the main sheave 12 are located is pierced by two cable holes 18 through which the cable 13 moves up and down.

The lower side of the machine room in which the winch 11 and the like are located is a hoistway 19 for the elevator on the other side of the floor 17 and the opening portions on each floor linked by the hoistway 19 are provided with doors 20 so that when these doors are opened, the elevator cage 14 is linked with the elevator hall 21 via the opening portions.

In addition, the configuration is such that the vibration noise of an elevator such as this does not leak in the direction of the elevator hall 21, the elevator cage 14, and the elevator hoistway 19 because of a conventional vibration noise prevention apparatus 25. This vibration noise prevention apparatus 25 comprises a cylindrical noise prevention duct 26 located at the floor 17 so as to allow a slight amount of sway accompanying the up and down motion of the cable 13 on the upper side of the openings of the cable holes 18, and a noise absorption material 27 that is provided so as to surround the cable on the surface of the inner circumference of the cylindrical noise prevention duct 26. Also, the entire winch 11 is not directly mounted on the floor 17 but is mounted on a damper member 28 so as to prevent the transmission of vibration noise to the lower side of the machine room. This damper member 28 also comprises the cylindrical noise prevention duct 26, the noise absorption material 27 and the vibration noise prevention apparatus 25.

However, even if the conventional vibration noise prevention apparatus 25 having the configuration described above is provided, there must be the necessary minimum gap between the cable 13 and the noise absorption material 27 so as to permit a slight amount of sway of the cable 13 when it moves up and down and there is the problem that the vibration noise that is caused by driving the winch 11 is transmitted from this gap to the elevator cage 14 and the elevator hall 21.

In this manner, there have been proposed various countermeasures for the suppression of vibration of the winch 11 itself and for the provision of vibration noise prevention apparatus 25 having the conventional configuration described above. For example, when a motor (not indicated in the figure) is provided inside the winch 11, it is fixed by bolts with rubber or some other noise absorbing material there between, and other noise absorbing material is wrapped around the outside of the motor itself, while squeaking and other noises occurring between the main sheave 12 and the output shaft of the motor are prevented by a high-precision gear mechanism and the like. The external transmission of vibration can be prevented in such a manner but when these noise prevention means are implemented for apparatus such as the winch 11 in the machine room, the apparatus itself increases in size and the effective space inside the machine room is reduced and there is the new problem of an increase in the elevator manufacturing cost.

SUMMARY OF THE INVENTION

In order to solve the problem described above, an object of the present invention is to provide an elevator noise prevention apparatus that can prevent an increase in the size and cost of the apparatus and equipment inside the machine room, and that can prevent or suppress the transmission of vibration noise from the winch and the like to the elevator shaft and the inside of the elevator cage.

In order to attain the above object, the present invention comprises a vibration detection apparatus provided for a machine room on the topmost floor of a building that detects vibration and which is mounted on a winch provided for a main sheave around which is wound a cable which moves up and down and to which an elevator cage and a counterweight are attached, a leak noise calculation circuit that processes the vibration detected by this vibration detection apparatus and calculates the vibration noise that leaks to the elevator hoistway from the cable holes, a sound signal generation circuit that generates sound signals of the opposite phase to the phase of the noise waveform calculated by this leak noise calculation circuit, and a sound generation unit that is provided in the vicinity of the cable holes and converts the sound signals of the opposite phase to the noise waveform generated by the sound signal generation circuit into an actual sound which is output.

When a winch is operated accompanying the use of the elevator, the motor that is built into the winch is rotationally driven and the magnetic apparatus such as solenoid brakes and the like are operated and there also occurs the meshing of the reduction gears. These operations generate vibration noise in the machine room because of various causes and this noise is transmitted to the inside of the elevator hoistway via the cable holes. A large proportion of this vibration noise is detected by a vibration detector in the above configuration mounted on the winch which outputs vibration detection signals to the noise calculation circuit. On the basis of the detection signals supplied the noise calculation circuit predicts and calculates the vibration noise that is expected to pass through the cable holes. There are no major differences in the vibration noise depending upon whether the direction of motion of the elevator is upwards or downwards, or whether the elevator is at full or half capacity, or empty. Accordingly, the noise that is caused by the vibration detected from a constant vibration is classified into one of several types of patterns. The predicted generated noise calculated by the calculation circuit has its noise waveform predicted, and this waveform is supplied to the sound generation circuit. The sound signal generation circuit analyzes the phase of the input predicted noise waveform, and generates sound signals of the phase opposite to that phase. These opposite phase sound signals are supplied to a sound generation unit where they are converted into actual sound and output in the direction of the sound source of the vibration noise from the vicinity of the cable holes.

A configuration and function such as has been described above outputs actual sound having a phase opposite that of the vibration noise, in the direction of the sound source of the vibration noise and from the vicinity of the cable holes and so it is possible to greatly reduce the vibration noise that is transmitted to the inside of the elevator hoistway and the elevator cage via the cable holes. In addition, the reduction of the vibration noise that is transmitted to the inside of the elevator hoistway also reduces the noise that is transmitted to the elevator halls of each floor via the doors on each floor and this has the effect of increasing the comfort of all persons using the building.

DETAILED DESCRIPTION OF THE PREFERRED EMBODIMENTS

The following is a detailed description of the preferred embodiments of an elevator noise prevention apparatus relating to the present invention, with reference to the appended drawings.

Figure 1:
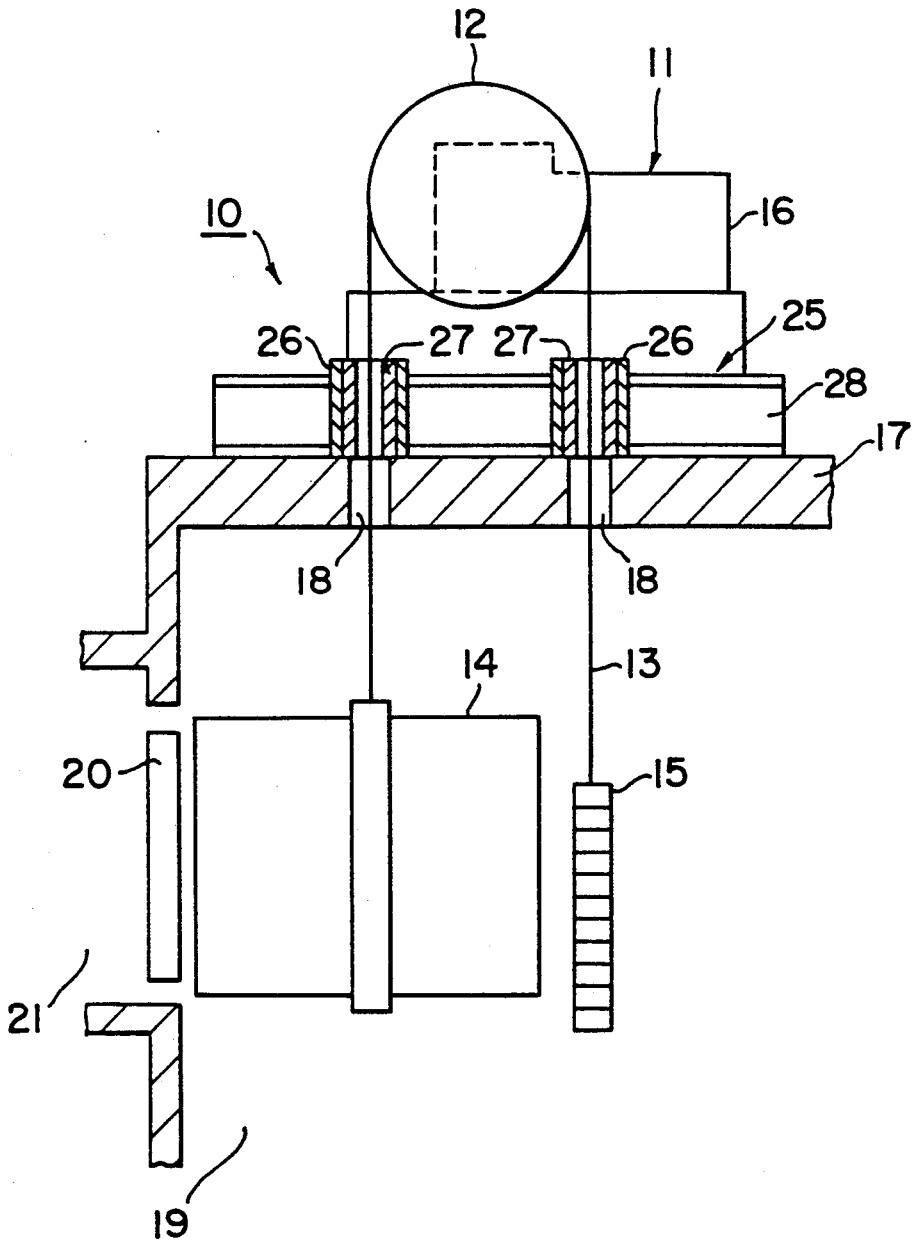
FIG. 1 PRIOR ART
FIG. 1 is a view showing an outline configuration of a conventional elevator noise prevention apparatus.

FIGS. 2 through 15 are views describing a first embodiment of the present invention, and those portions of these figures that are the same as corresponding portions of FIG. 1 are indicated with the same numerals, and the corresponding descriptions of them are omitted.

Figure 2:
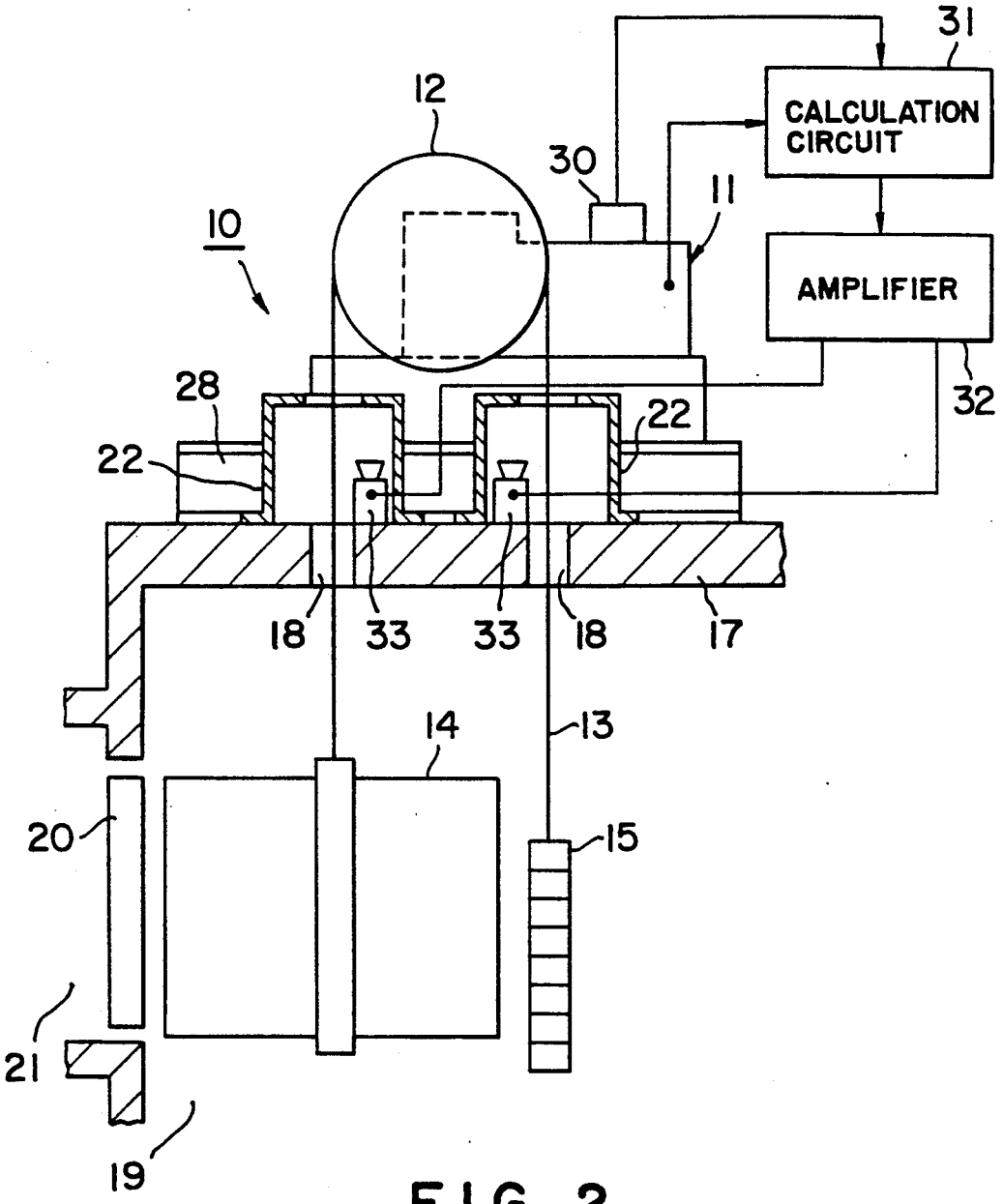
FIG. 2 is a side view of a partial section showing an outline configuration of an elevator noise prevention apparatus of a first embodiment of the present invention.

In FIG. 2, a noise prevention apparatus comprises a vibration detector 30 located on a winch 11, a leak noise calculation circuit 31 that calculates the vibration noise that leaks to the elevator shaft from the cable holes 18, an amplifier 32 that amplifies and outputs the audio signals that are calculated and generated by this leak noise calculation circuit 31, and a speaker 33 that generates actual sounds for cancelling the noise on the basis of the amplifier output of the amplifier and which is mounted in the upwards direction of a noise prevention duct provided for the floor 17 of the machine room of the elevator. The leak noise calculation circuit 31 basically detects the vibration of the motor (not indicated in the figure) but in addition, simultaneously detects the magnetic vibration of the apparatus for magnetic braking, and the vibration of the meshing of the gears of the governor. The leak noise calculation circuit 31 comprises a noise prediction means that calculates the predicted vibration noise that will leak from the cable holes 18 to the elevator hoistway 19, and an opposite phase sound signal generation means that generates sound signals of a phase opposite the noise so as to cancel the predicted noise. On the basis of the sound signals of the phase opposite the noise waveform, the speaker 33 sends actual sounds in the direction of the noise source so as to cancel the noise.

In the first embodiment, the provision of the noise prevention duct 22 at the top of the cable holes 18 transforms the three dimensional vibration noise that is transmitted from the top of the inside of this noise prevention duct 22 into a waveform that is as flat as possible, generates audio signals that have an opposite phase waveform so as to cancel this flat wave and uses these sound signals as the basis for the generation of the actual sound to be used for cancellation.

Figure 3:
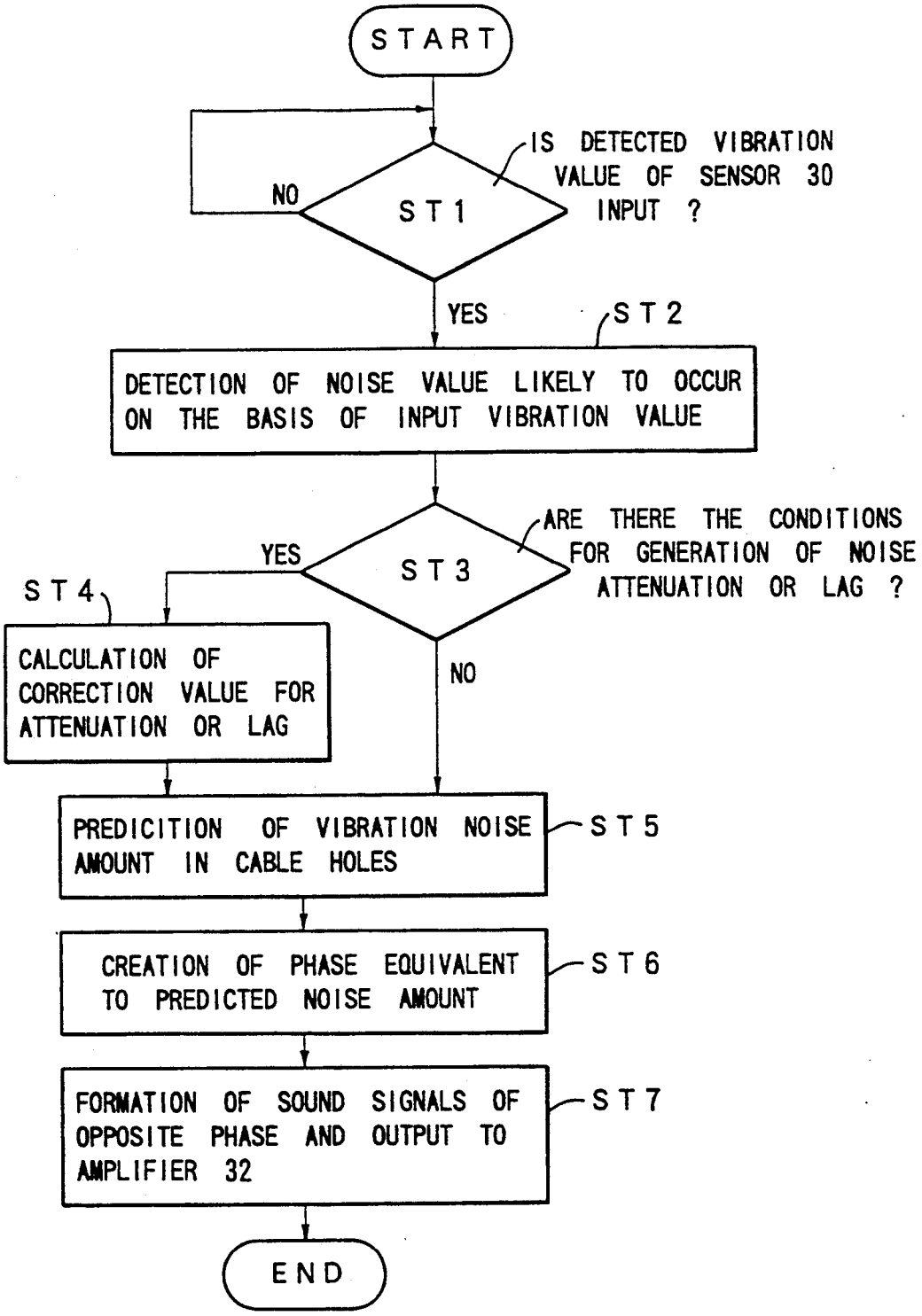
FIG. 3 is a flowchart showing the steps for describing the operation of the elevator noise prevention apparatus of the first embodiment of the present invention.

The following is a description of the operation of a leak noise calculation circuit 31 in an elevator noise prevention apparatus relating to the first embodiment of the present invention with reference to FIG. 3.

First, in step ST1, the leak noise, calculation circuit 31 judges whether or not a detected output from the vibration detector 30 such as a vibration sensor or the like is being supplied. If there is no detected output supplied, then the vibration detector of the governor, magnetic brake and the motor that drives the elevator are immediately placed in a standby status until there is such supply. If detected output of the sensors is being supplied, then the vibration values that are input to the noise prediction means of the leak noise calculation circuit 31 are used as the basis for predicting the vibration noise having a flat wave and which may possibly be generated in the vicinity of the cable holes 18. This predicted vibration noise can have the predicted waveforms output in accordance with the vibration values that are detected since several typical waveforms are detected depending upon whether the elevator is going up or down, or depending upon the passenger load.

Then, in step ST3, a judgment is made as to whether or not the conditions such as attenuation the transmission delay and the like occur. The attenuation and the transmission delay are due to the provision of the duct 22 and the damper member 28. If there are conditions for the generation of attenuation and delay and the like, a correction value for this attenuation and/or delay is calculated in step ST4. When a correction value has been calculated in this step ST4, the noise prediction means of the leak noise calculation circuit 31 predicts the final predicted vibration noise amount that will leak from the cable holes 18 to the elevator hoistway 19 (step ST5).

When the vibration noise amount is predicted by the prediction means and the phase that is equivalent to the noise amount that has been predicted by the sound signal generation means of the leak noise calculation circuit 31 has been created in step ST6, a sound signal of the phase opposite that of the phase equivalent to the noise is generated in step ST7 and this signal is output to the amplifier 32.

The amplifier 32 that receives these sound signals amplifies these signals to a predetermined output in order to generate an actual sound to cancel the noise, and supplies it to the speaker 33. The speaker 33 uses the amplified signals supplied as the basis to generate a cancellation sound to cancel the noise. This cancellation sound is a flat wave of an opposite phase waveform so as to cancel the flat wave due to the noise, and is directed in the upwards direction so as to collide with the flat waveform moving from the top of the noise prevention duct 22 downwards in the elevator hoistway 19. Accordingly, the vibration noise that is generated when the motor and the like (not indicated in the figure) of the winch 11 is driven is either cancelled or reduced.

FIGS. 4 through 15 are for describing the status of the vibration noise that is generated about the machine room of an actual elevator, for the first embodiment described above.

Figure 4:
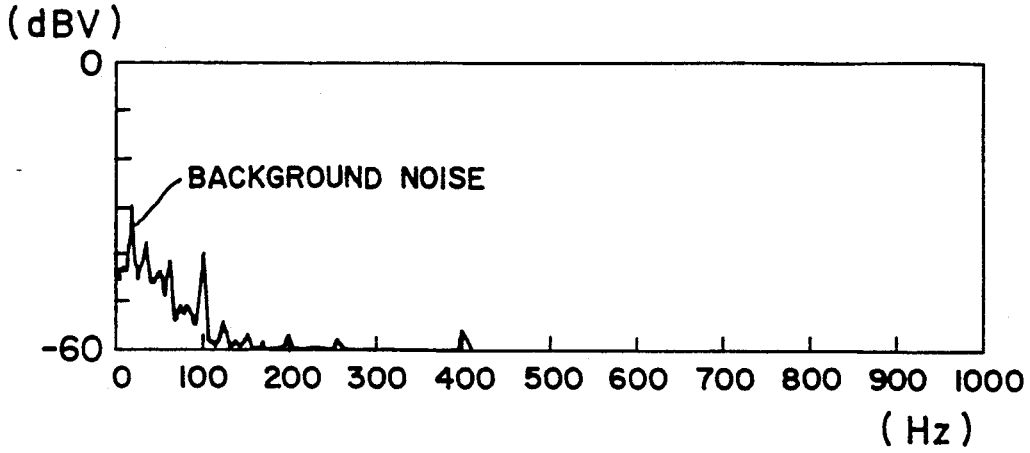
FIGS. 4 through 6 are characteristics graphs showing a frequency analysis of the noise of reduction gears provided in a machine room in an elevator to which the elevator noise prevention apparatus of the present invention has been applied.
Figure 5:
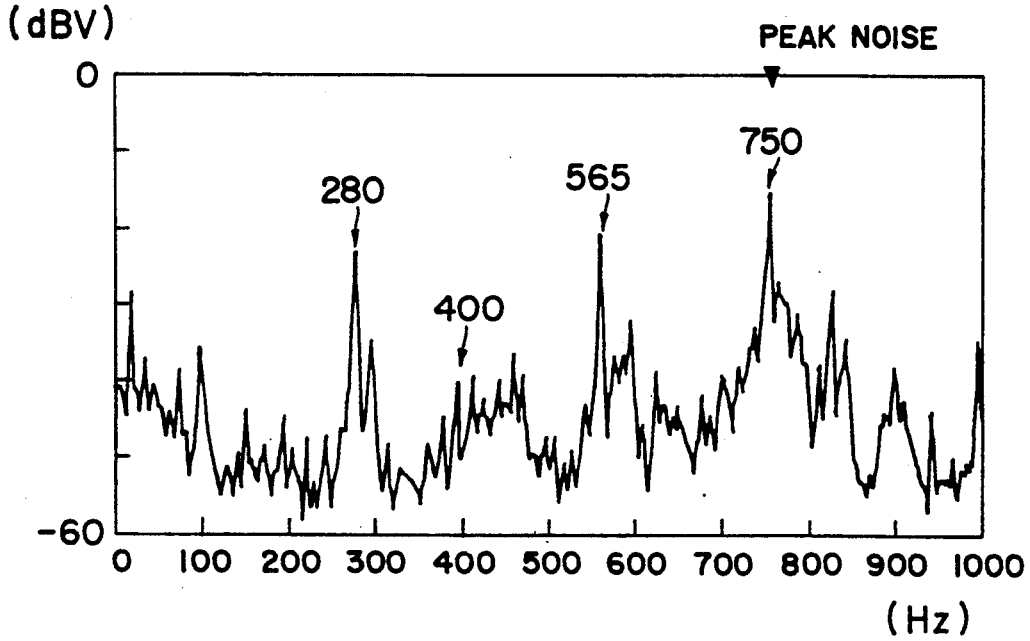
Figure 6:
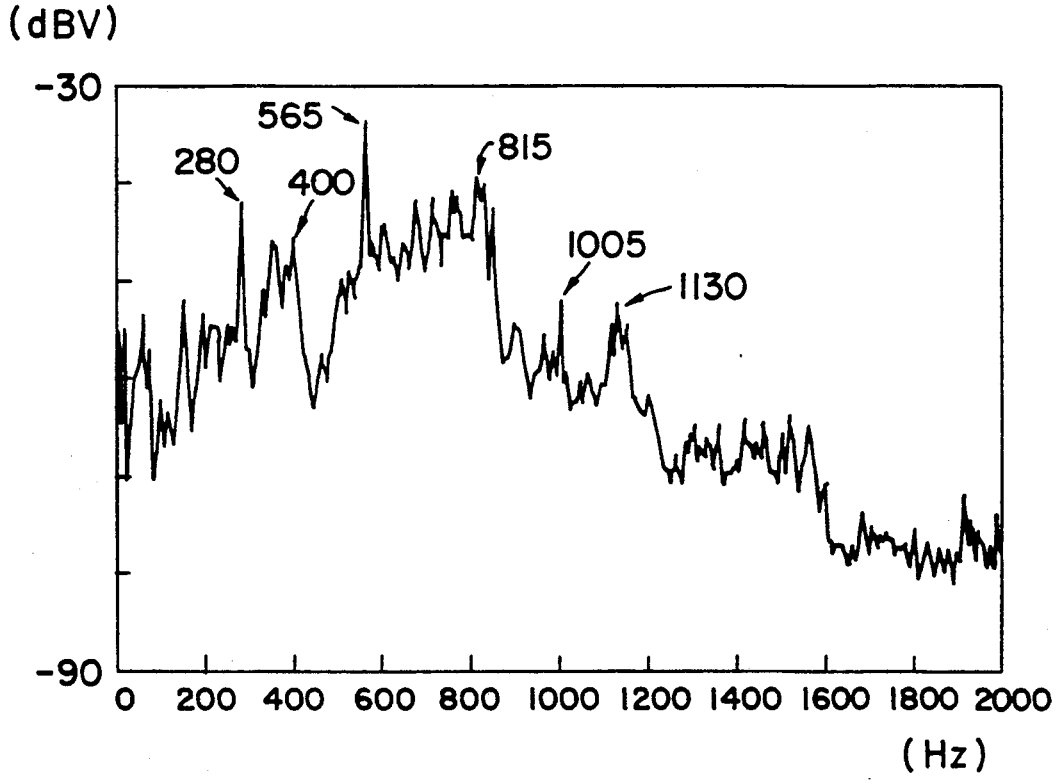

FIGS. 4 through 6 are frequency analyses of the vibration noise of a governor or reduction gear provided to the winch 11 in the machine room, with FIG. 4 showing the correlation between the background noise in the machine room, and decibel level and the vibration frequency. Here, the term "background noise" refers to the noise at a place when there is not the object noise (such as the vibration noise of a governor in this case). The measured values are influenced if there is a large amount of the background noise, but there is practically no influence if the background noise is at least 10 dB less than the object noise.

FIG. 5 shows the measured values for the vibration noise to the side of the governor, for the instance when the elevator is going down normally with a light load, and when the governor is mounted on vibration absorbing rubber. According to the measured values, there are several peaks at 280 Hz, 400 Hz and 565 Hz and the like but the largest peak is at 750 Hz, so that sound of the opposite phase can be generated for these peak values to cancel the noise.

FIG. 6 shows the values that were measured in the same manner for governor vibration, and are for the vibration on the gearcase when the elevator is operating in the same manner. In this case, the gearcase is not mounted on vibration absorbing rubber, and although there peak at 565 Hz is the largest as was the case for FIG. 4.

Figure 7:
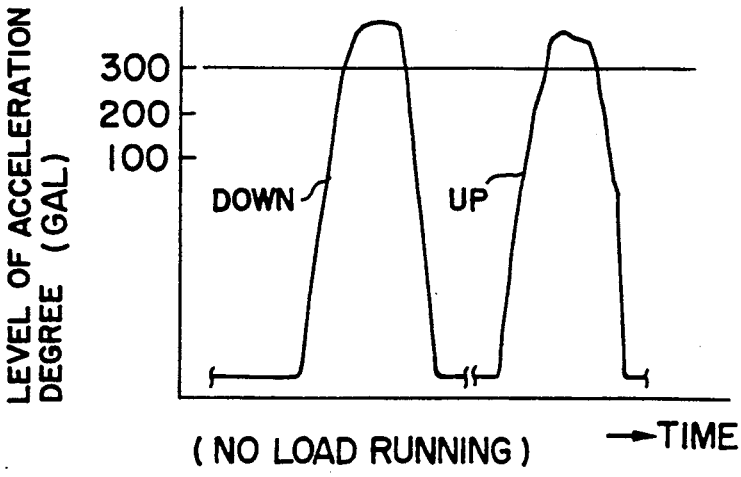
FIGS. 7 through 9 are characteristics graphs showing the correlation between the vibration noise of reduction gears provided in a machine room in an elevator to which the elevator noise prevention apparatus of the present invention has been applied, and the time and the acceleration level.
Figure 8:
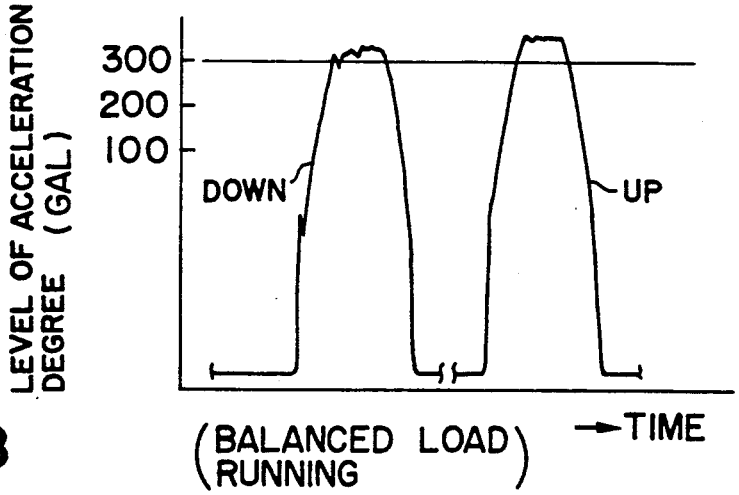
Figure 9:
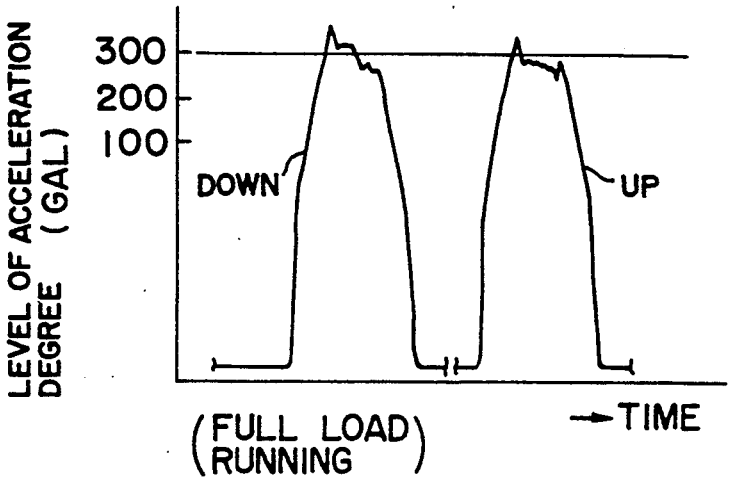

The following is a description of the change in the vibration level with respect to time of the governor vibration, with respect to FIGS. 7 through 9. FIG. 7 uses the degree of acceleration to show the vibration when there is no load inside the elevator cage 14 and when the elevator cage is going up. In addition, FIG. 8 shows the vibration when there is 100% load inside the elevator cage 14 and when the elevator cage is going down. Furthermore, FIG. 9 uses the degree of acceleration to show the vibration with there is 45% load inside the elevator cage 14, when the elevator cage 14 and the counterweight 15 are balanced, and for when the elevator is going down and for when the elevator is going up. As can be seen from these three figures, the level of the vibration noise is such that there is a vibration peak in the vicinity of an acceleration of 300 gal, irrespective of the size of the load inside the elevator cage 14 and irrespective of whether the elevator cage 14 is going up or down.

Figure 10:
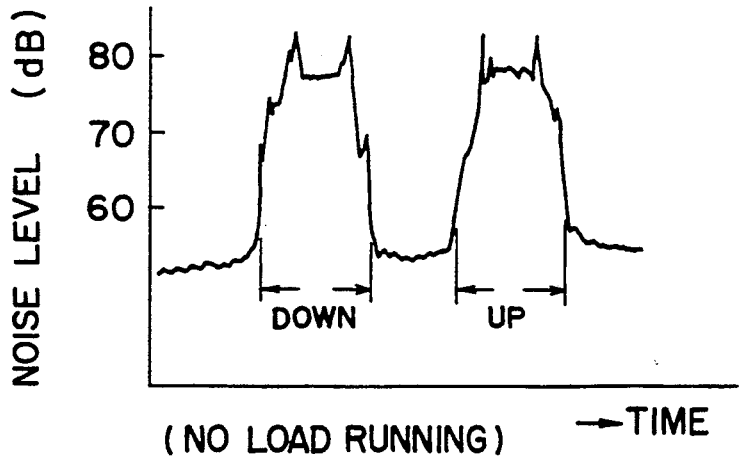
FIGS. 10 through 12 are characteristic graphs showing the correlation between the vibration noise of a motor in a machine room of an elevator to which the elevator noise prevention apparatus of the present invention has been applied, and the decibel level and time.
Figure 11:
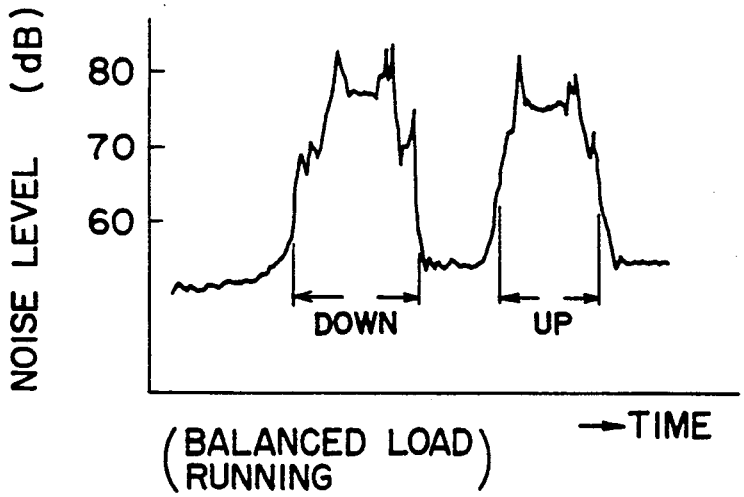
Figure 12:
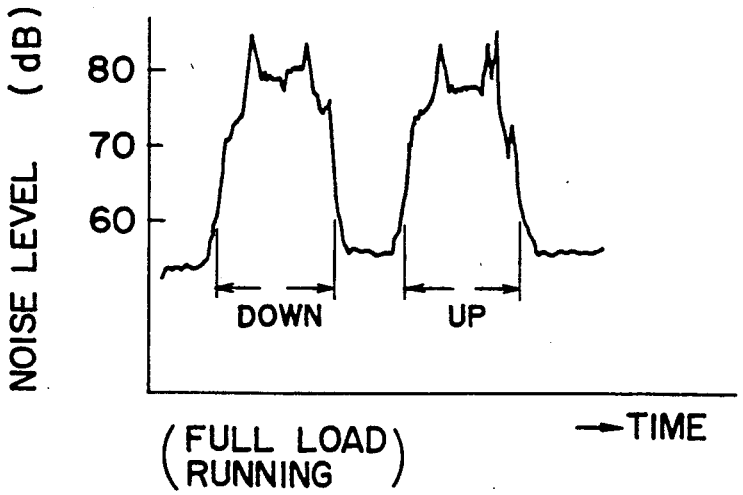

FIGS. 10 through 12 show values that were measured as the time change of the decibel level, for the vibration noise of the motor of the winch 11 in the machine room, with FIG. 10 showing the time change of the noise level when there is running under no load, FIG. 11 showing the time change of the noise level when there is running under balanced load, and FIG. 12 showing the time change of the noise level when there is running under full load. Even under these different running conditions, the noise level when the elevator is going down and when it is going up changes between 60 and 80 decibels, and the composite of these cancellation sounds that cancel these vibration noises also have several typical opposite phase waveforms.

Figure 13:
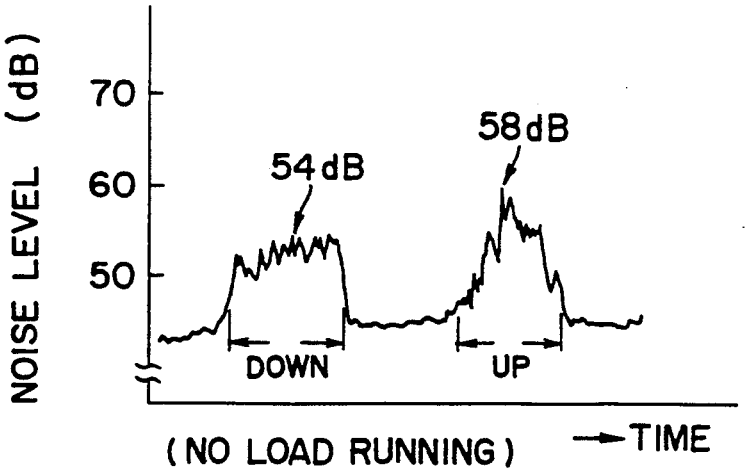
FIGS. 13 through 15 are characteristic graphs showing the correlation between the vibration noise inside the elevator cage of an elevator to which the elevator noise prevention apparatus of the present invention has been applied, and the decibel level, and time.
Figure 14:
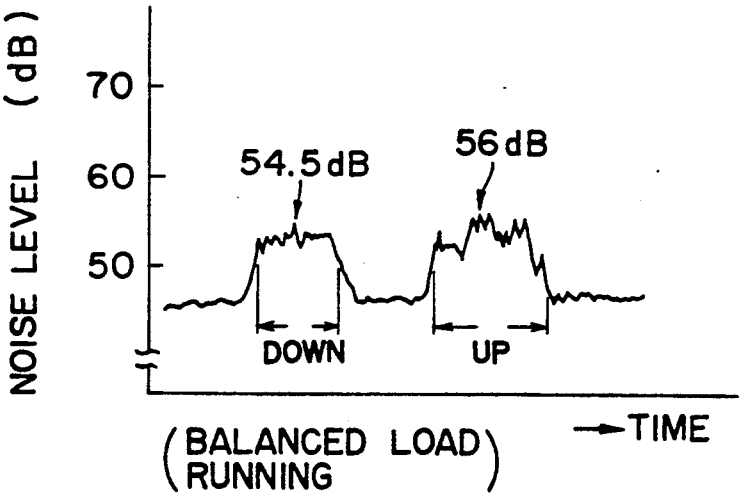
Figure 15:
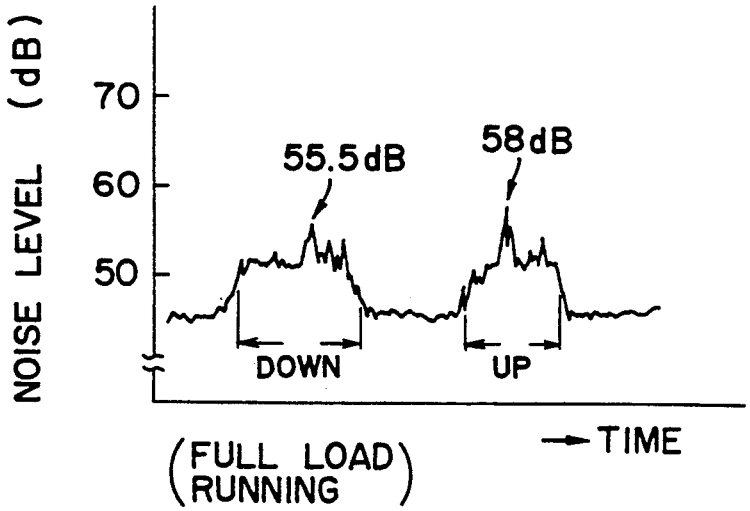

Finally, FIGS. 13 through 15 show the measured levels for the noise inside the elevator cage 14 of the elevator. The peak of the vibration noise which leaks from the machine room is in the level of 54 dB to 58 dB inside the elevator cage 14. However, even in elevator cages for which such sounds are recorded, it is still possible to cancel the vibration noise that leaks from the machine room when the elevator is going up and down.

Figure 16:
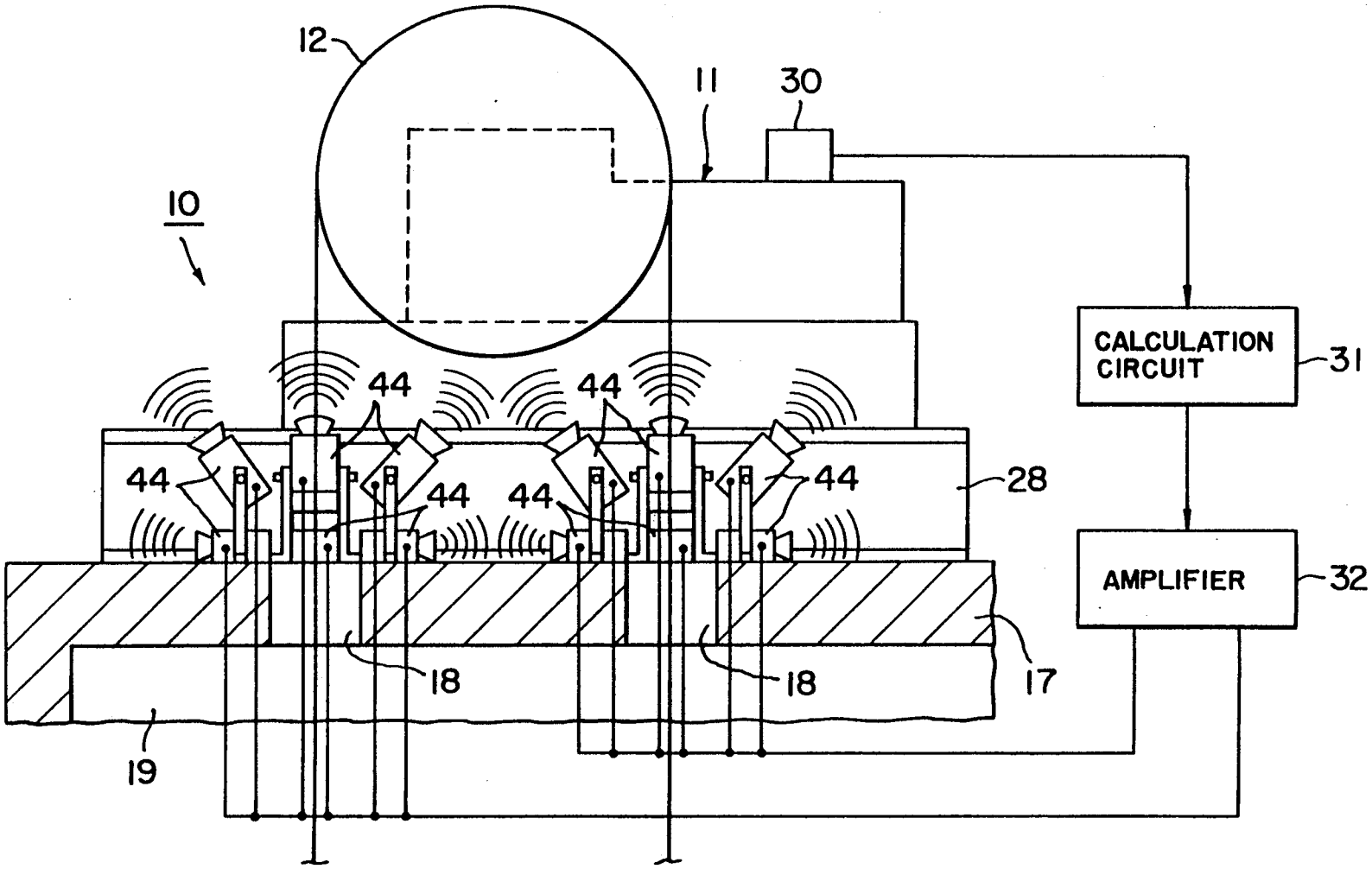
FIG. 16 is a side view of a sectional view showing an outline configuration of an elevator with the elevator noise prevention apparatus according to a second embodiment of the present invention.

The following is a description of a second embodiment of the elevator noise prevention apparatus related to the present invention, with reference to FIG. 16. This second embodiment is different from the first embodiment that uses a flat wave where the cancellation sound is of opposite phase to the vibration noise is a composite of three dimensional waves and is output in the direction of the vibration noise source.

More specifically, as shown in FIG. 16, instead of the noise prevention duct 22 and the speaker 33 of the first embodiment, a plural number of speakers 44 are arranged in the vicinity of the cable holes and facing in all directions from which the machine room can be a noise source. In this second embodiment, a total of 16 speakers 44 are arranged two in each of four directions around each of the two cable holes. These 16 speakers 44 generate cancellation sound of opposite phase to the vibration sound and cancel the vibration noise that passes through the cable holes 18. Other than the fact that the calculation apparatus changes the cancellation sound from a flat wave to a three dimensional wave, the other aspects of this configuration are the same as those of the first embodiment, and so the description of the effects and the operation as described in FIGS. 3 through 15 will be omitted here.

In the case of the noise prevention apparatus of this second embodiment, the number and the directions of the speakers that are arranged correspond to the arrangement of the machine room and data that is obtained from test results is used as the basis for setting the sound that is effective in cancelling the vibration noise. In addition, the various types of detection signals that are supplied to the control panel of the winch 11 are supplied to the leak noise calculation circuit 31 and these control elements can operate to cancel the vibration noise.

In these first and second embodiments, the vibration detection apparatus 30 uses a general vibration pickup to detect the acceleration, speed or phase and generates a voltage that is proportional to the detected acceleration, speed or phase. For example, when an acceleration pickup is used as the vibration detector, the configuration has a piezo-electric pickup having a built-in spring (dynamo). This type has a fixed period of vibration of 10 kHz or more and the piezo-electric element has the role of a spring and so it functions as an acceleration pickup in a frequency region which is sufficiently low.

Also, if the leak noise calculation circuit 31 predicts and obtains the phase of the noise that is generated by the vibration on the basis of the detected vibration waveform, then it can be applied whether there is a conventional analog type of frequency analyzer, a digital frequency analyzer that uses a fast Fourier transform (FFT), or whether an A/D converter and a computer are used to digitalize the vibration waveform and calculate the power spectrum.

Figure 19:
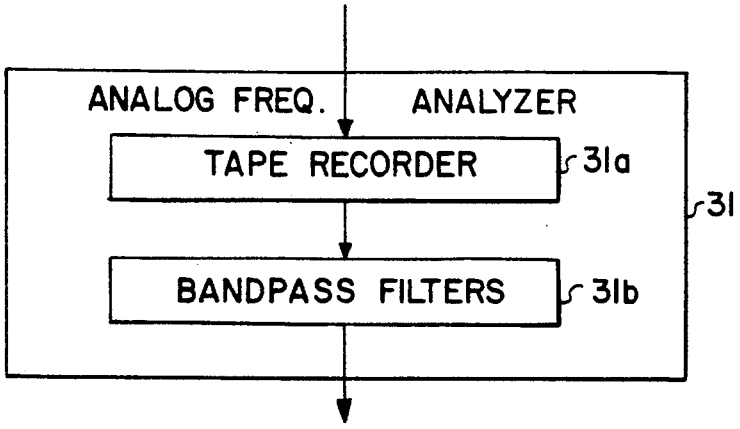
FIGS. 19 to 21 are block diagrams showing different techniques for implementing the calculation circuit.

FIG. 19 shows an analog type of frequency analyzer which passes the waveform data of the vibration through band-pass filters 31*b* while reproducing it from a tape recorder 31*a* or the like, and measures the actual values that exist in each of the frequency bandwidths and so these types of analyzer are classified according to the type of band-pass filter, into constant proportion band frequency analyzers and constant bandwidth frequency analyzers. The constant bandwidth frequency analyzer is used particularly for the measurement and analysis of mechanical vibration since it is possible to finely divide the frequencies with at high resolution, and the central frequency of the band-pass filters of these constant bandwidth analyzers is created using a heterodyne equation that is an arithmetic progression.

Figure 20:
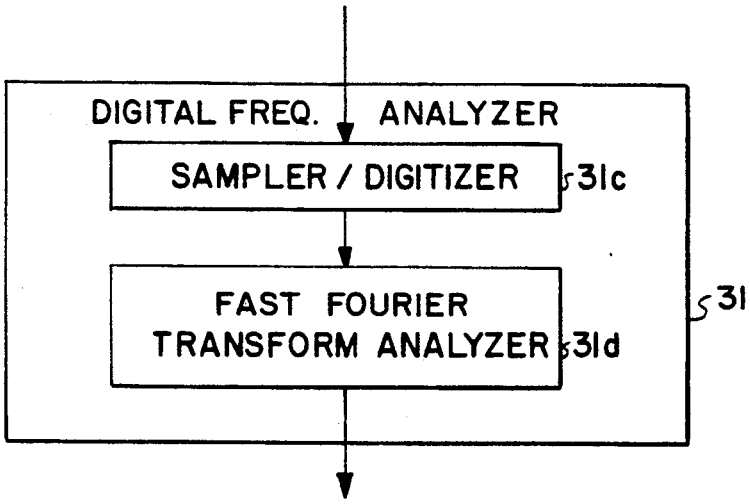

FIG. 20 shows a digital type of frequency analyzer is stage 31*d* performs a Fourier transform of the waveform data that has been sampled in stage 31*c* for each time interval and determines the power spectrum for frequencies in an arithmetic progression. FFT are used as the Fourier transforms. Commercially available digital frequency analyzers have a digital transient memory and are known as FFT analyzers, or spectrum analyzers. These analyzers perform digital signal processing and so facilitate various types of analyses.

Figure 21:
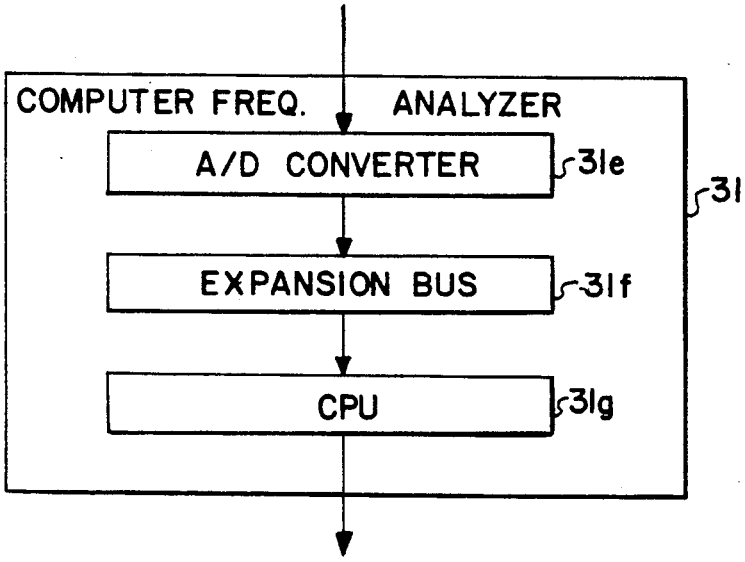

FIG. 21 shows a supported frequency analyzer which extends the analog/digital converter 31*e* that converts the analog data into digital data, into a computer bus 31*f* for a computer 31*g* that functions as an A/D converter by either an internal or an external program. The waveform data is converted into numerical data for each time interval and stored in the user region of the internal or expansion memory of the computer. This data is inserted into array elements of a program and FFT is performed by a predetermined program and the spectrum determined.

These various types of apparatus and methods can be used to analyze the detected vibration waveform and determine the power spectrum, and use the determined waveform as the basis to predict the vibration noise that is generated and that passes through the cable holes 18. If the predicted waveform is created, then its phase can be determined and so cancellation sound signals of opposite phase can created and converted into actual sound so that it is possible to either eliminate or reduce the vibration noise.

Figure 17:
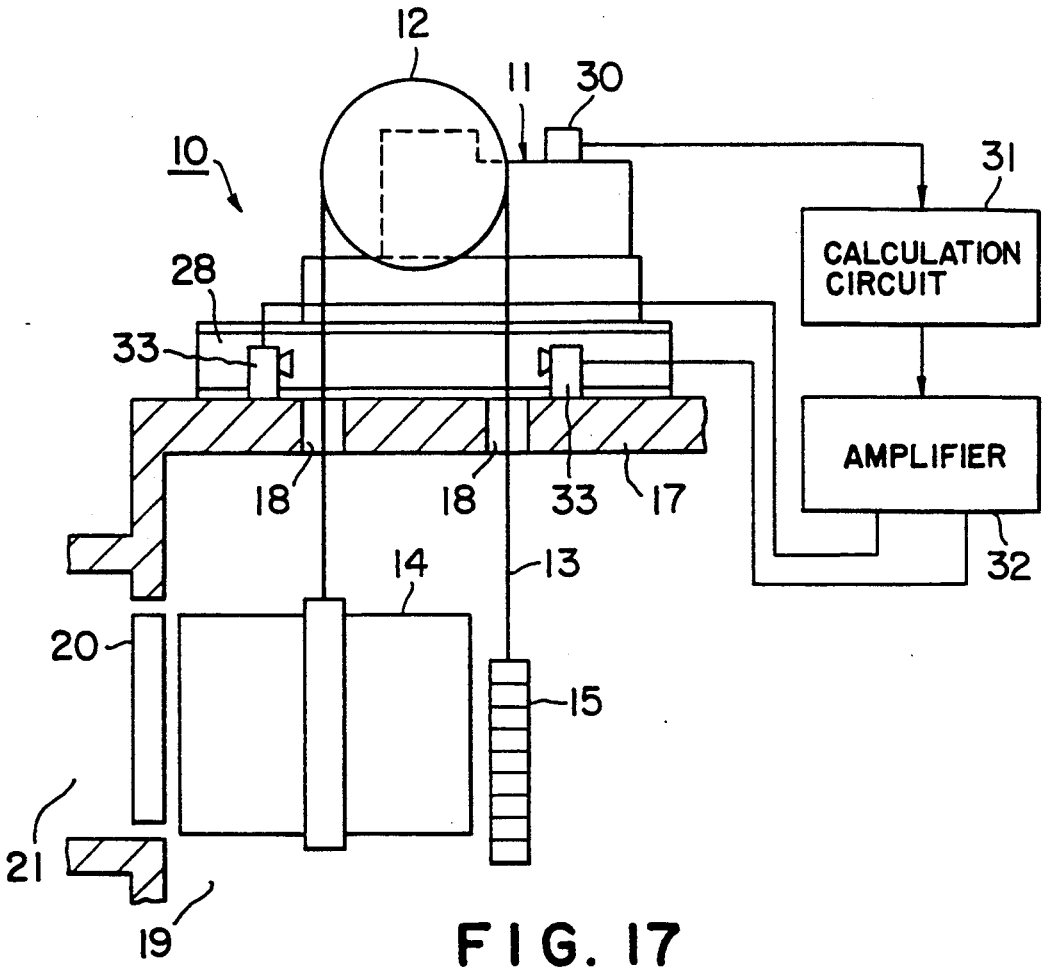
FIG. 17 is a side view of a sectional view showing an outline configuration of an elevator to which the elevator noise prevention apparatus according to a third embodiment of the present invention.
Figure 18:
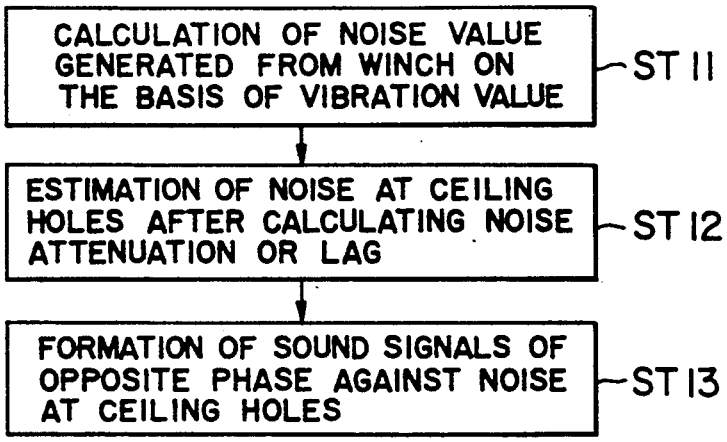
FIG. 18 is a flowchart showing the steps for describing the operation of an elevator noise prevention apparatus of the third embodiment of the present invention.

The present invention may be constructed as a third embodiment shown in FIGS. 17 and 18 without limitation of FIG. 17 having the same numerals affixed as in FIGS. 2 and 6 are the same elements as in the prevention apparatuses of the first and second embodiments, a duplicate description is omitted. An apparatus according to the third embodiment has a different configuration in which two speakers 33 are respectively mounted on the floor surface of the machine room 10 immediately beside the cable holes 18, respectively, thereby generating the sound for cancelling the noise.

The calculation circuit 31 operates to provide the vibration noise, the leak noise and the sound signals having the opposite phase in the manner of the a flowchart shown in FIG. 18. First, the several functions are preset in the circuit 31 with respect to the noise generated by diffusion, attenuation, time lag and the like in the machine room, for use in the calculation of noise.

When the circuit 31 receives the vibration output from the winch 11, the vibration is operated as the noise having a correlation of "1:1" (see step ST11). The leak noise that is passed through the cable holes 18 and 18 of the machine room 10 to the hoistway 19, is calculated and estimated by using the functions with respect to the diffusion, attenuation and time lag (step ST12). After the leak noise is estimated, the sound signals of the opposite phase of the leak noise are calculated for cancelling the noise (step ST13).

The sound signals having a phase opposite to the leak noise are amplified by the amplifier 32 to generate sound signals corresponding to the leak noise. The amplified sound signals are supplied to the speakers 33 and 33 so as to be formed as the actual sound having the opposite phase. The actual sound cancels the noise generated by the winch 11, thereby reducing the leak noise through the cable holes 18 and 18.

Therefore, it is possible to decrease the noise transmitted from the machine room through the cable holes and hoistway to the elevator hall.

What is claimed is:

1. A cable winch elevator noise prevention apparatus provided with a winch on the topmost floor of a building and having a main sheave that winds a cable up and down, to both ends of said cable are fixed an elevator cage and a counterweight, and at least two cable holes opened in a floor of a machine room on said topmost floor where said winch is installed, so as to allow said cable wound around said main sheave to pass through and move freely up and down, and characterized in being provided with:

vibration detection means for detecting vibration noise, said vibration detection means being mounted in the vicinity of a vibration noise source inside said machine room including said winch, noise prediction means for using said vibration noise detected by said detection means to predict phase and frequency of vibration noise leaking from said cable holes to an elevator hoistway as a noise waveform;

audio signal generation means for generating noise cancellation sound signals having an opposite phase to a phase of said noise waveform predicted by said prediction means, and cancellation sound generation means located in the vicinity of said cable holes for converting into actual sounds said noise cancellation sounds having said opposite phase to said predicted noise waveform generated by said audio signal generation means.

2. The noise prevention apparatus of claim 1, wherein:

said cancellation sound generation means comprises a noise prevention duct that converts into a two dimensional flat wave three dimensional noise emitted from said vibration noise source in the direction of said cable holes, and a speaker provided inside said noise prevention duct for generating a flat wave for noise cancellation having a phase opposite that of said noise converted into said two dimensional flat wave.

3. The noise prevention apparatus of claim 1, wherein:

said cancellation sound generation means comprises a plurality of speakers arranged in many directions in the directions of a plural number of noise sources in the vicinity of said cable holes, so as to cancel said vibration noise transmitted from said vibration noise source as a three dimensional wave to said cable holes.

4. The noise prevention apparatus of claim 1, wherein:

said vibration detection means comprises a degree of acceleration pickup located on an upper surface of said winch.

5. The noise prevention apparatus of claim 1, wherein:

said noise prediction means comprises a calculation apparatus provided between said vibration detection means and said cancellation sound generation means.

6. The noise prevention apparatus of claim 5, wherein:

said calculation means comprises a data recorder for reproducing waveform data relating to said detected vibration noise, a bandpass filter group comprising a plurality of bandpass filters passing certain components of frequency bandwidths so as to measure effective values of components of said waveform data reproduced from said data recorder.

7. The noise prevention apparatus of claim 5, wherein:

said calculation means comprises a digital type frequency analyzer for sampling at a certain interval and for producing digitalized data and determining from said data a power spectrum at frequencies in an arithmetic progression.

8. The noise prevention apparatus of claim 7, wherein:

said digital type frequency analyzer comprises a fast Fourier transformer analyzer for processing said waveform data by fast Fourier transform processing.

9. The noise prevention apparatus of claim 5, wherein:

said calculation apparatus comprises a computer supported frequency analyzer comprising an analog/digital converter for converting into digital data analog waveform data detected by said vibration detector, a central processing unit using an internal or external program to process digital data converted by said converter, and an expansion bus to said CPU to expand said analog/digital converter.

10. The noise prevention apparatus of claim 5, wherein:

said calculation apparatus outputs opposite phase audio signals for cancellation of said noise and an amplifier for amplifying said opposite phase audio signals and supplying said signals as amplified to a speaker comprising said sound generation means.

* * * * *